US007223529B1

(12) United States Patent
Zengerle et al.

(10) Patent No.: US 7,223,529 B1
(45) Date of Patent: May 29, 2007

(54) SILVER HALIDE LIGHT-SENSITIVE ELEMENT

(75) Inventors: Paul L. Zengerle, Rochester, NY (US); Christopher J. Haller, Rochester, NY (US)

(73) Assignee: Eastman Kodak Company, Rochester, NJ (US)

( * ) Notice: Subject to any disclaimer, the term of this patent is extended or adjusted under 35 U.S.C. 154(b) by 0 days.

(21) Appl. No.: 11/429,614

(22) Filed: May 5, 2006

(51) Int. Cl.
*G03C 1/46* (2006.01)

(52) U.S. Cl. ..... 430/502; 430/546; 430/552; 430/553; 430/558; 430/523; 430/531; 430/631

(58) Field of Classification Search ..... 430/502, 430/546, 552, 553, 558, 523, 531, 631
See application file for complete search history.

(56) References Cited

U.S. PATENT DOCUMENTS

| | | | | |
|---|---|---|---|---|
| 2,322,027 | A | 6/1943 | Jelley et al. | |
| 2,801,170 | A | 7/1957 | Vittum et al. | |
| 3,042,522 | A | 7/1962 | Ben-Ezra | |
| 3,121,060 | A | 2/1964 | Duane | |
| 3,489,567 | A | 1/1970 | McGraw | |
| 3,862,860 | A | 1/1975 | Pardee et al. | |
| 4,623,614 | A | 11/1986 | Yoneyama et al. | |
| 5,112,729 | A | 5/1992 | Mihayashi | |
| 5,208,139 | A | 5/1993 | Ishigaki | |
| 5,529,891 | A | 6/1996 | Wang et al. | |
| 5,541,048 | A | 7/1996 | Whitesides et al. | |
| 5,807,661 | A | 9/1998 | Landry-Coltrain | |
| 5,834,175 | A | 11/1998 | Zengerle et al. | |
| 5,879,867 | A | 3/1999 | Zengerle et al. | |
| 5,891,613 | A | 4/1999 | Zengerle et al. | |
| 6,068,957 | A | 5/2000 | Nair et al. | |
| 6,165,702 | A | 12/2000 | Smith et al. | |
| 6,228,570 | B1 | 5/2001 | Freeman et al. | |
| 6,613,503 | B1 | 9/2003 | Isaac et al. | |
| 6,740,480 | B1 * | 5/2004 | Aylward et al. | 430/510 |
| 6,875,563 | B2 * | 4/2005 | Orem et al. | 430/512 |
| 6,913,874 | B2 | 7/2005 | Haller et al. | |

FOREIGN PATENT DOCUMENTS

| | | |
|---|---|---|
| GB | 1143118 | 2/1969 |
| JP | 51-04163 | 2/1976 |

OTHER PUBLICATIONS

U.S. Appl. No. 11/261,047, filed Oct. 28, 2005; titled "Silver Halide Light-Sensitive Element"; of Paul L. Zengerle, Christopher J. Haller.

* cited by examiner

*Primary Examiner*—Geraldina Visconti
(74) *Attorney, Agent, or Firm*—Andrew J. Anderson

(57) ABSTRACT

A silver halide light-sensitive photographic element comprising a support having on one side thereof at least one cyan image forming hydrophilic colloid layer comprising a cyan image dye forming coupler, and an outermost protective overcoat layer providing a coefficient of friction of less than 0.20 after standard ECP-2B processing, wherein the ratio of permanent solvent to coupler in the cyan image forming layer is less than 0.8.

20 Claims, No Drawings

SILVER HALIDE LIGHT-SENSITIVE ELEMENT

TECHNICAL FIELD

This invention relates to the field of silver halide light-sensitive elements, and in particular to photographic elements having at least one layer containing a cyan dye forming coupler and a relatively low solvent level, and an overcoat layer providing a relatively low coefficient of friction. In a particular aspect, it relates to motion picture print films.

BACKGROUND OF THE INVENTION

Various techniques are known for dispersing hydrophobic photographically useful compounds such as photographic couplers into photographic element layer coating compositions comprising hydrophilic colloids.

Photographic dye forming couplers, as well as other hydrophobic photographically useful compounds, are typically incorporated into a hydrophilic colloid layer of a photographic element by first forming an aqueous dispersion of the couplers and then mixing such dispersion with the layer coating solution. An organic solvent is typically used to dissolve the coupler, and the resulting organic solution is then dispersed in an aqueous medium to form the aqueous dispersion.

The organic phase of these dispersions frequently includes high boiling or permanent organic solvents, either alone or with low boiling or water miscible solvents which are removed after dispersion formation. Permanent high boiling solvents have a boiling point sufficiently high, generally above 150° C. at atmospheric pressure, such that they are not evaporated under normal dispersion making and photographic layer coating procedures. Permanent high boiling coupler solvents are primarily used in the conventional "oil-protection" dispersion method whereby the organic solvent remains in the dispersion, and thereby is incorporated into the emulsion layer coating solution and ultimately into the photographic element.

The conventional "oil in water" dispersion method for incorporating hydrophobic couplers is described, e.g., in U.S. Pat. No. 2,322,027 by Jelly and Vittum. In such conventional process, the coupler is dissolved in a high boiling water immiscible solvent, mixed with aqueous gelatin, and dispersed using a colloid mill or homogenizer. The presence of the high boiling solvent provides a stable environment for the hydrophobic coupler, as well as generally increasing the reactivity of the coupler upon photographic processing. The presence of high levels of permanent solvent in photographic elements, however, may adversely impact the physical integrity of such elements.

Photographic dispersions and layers of photographic elements that contain relatively low levels of permanent solvent or essentially no coupler solvent at all are known in the art. Dispersions of photographic compounds made without permanent solvent are described, e.g., in U.S. Pat. No. 2,801,170. Co-dispersions of yellow dye forming couplers and yellow dye light stabilizers made with no coupler solvent to improve light stability are described in U.S. Pat. No. 5,891,613. Yellow coupler dispersions featuring high coupler reactivity in a no solvent environment to facilitate layer thinning and to improve light stability are described in U.S. Pat. No. 5,879,867. In general, however, coupler dispersions containing little or no permanent solvent have lower coupler reactivity than solvent-rich dispersions, which is undesirable since higher material laydowns are required resulting in higher manufacturing cost. This is especially true with dispersions of cyan dye forming couplers. U.S. Pat. No. 5,112,729 describes a photographic material containing a cyan naptholic coupler and a high-boiling solvent present in a weight ratio with respect to the coupler in the layer of not more than 0.3. Low solvent dispersions of cyan dye forming couplers to provide high coupler reactivity and enable reduced coated dry thickness are disclosed in U.S. Pat. No. 5,834,175. Use of cyan coupler dispersions with reduced levels of a saturated alcoholic high boiling solvent as permanent solvent to improve scratch resistance while maintaining high coupler reactivity are described in commonly assigned, copending U.S. Ser. No. 11/261,047, filed Oct. 28, 2005, the disclosure of which is incorporated by reference herein.

It is also known in the art to use various lubricants in the outermost layer of photographic elements to reduce friction and to improve their abrasion resistance. It is understood that the addition of such lubricants lowers the contact friction between the imaging element and potentially damaging surfaces as the two surfaces slide past one another in intimate contact. Examples of lubricants used to lower contact friction include silicone fluids as described in U.S. Pat. No. 3,489,567 and wax esters of fatty acids or alcohols contained in U.S. Pat. No. 3,121,060. Materials known to reduce sliding friction of silver halide containing photographic elements include dimethylsilicones and specific surfactants disclosed in U.S. Pat. No. 3,042,522, GB 1,143,118, and JP-A-51-14163. A surface layer having improved antistatic properties and lubricity is described in U.S. Pat. No. 4,623,614. The combination of a silicone copolymer and colloidal silica in the outermost protective layer of a photographic element having a dynamic friction coefficient of 0.35 or less is described in U.S. Pat. No. 5,208,139. Use of some of these lubricants may suffer the disadvantage of creating light scatter, which may reduce the maximum achievable densities in the imaging layers. Also, some of such lubricants have a propensity to transfer from the protective overcoat layer to the backside of the photographic element, or they may be partially removed during photographic processing thereby reducing their effectiveness.

Methods for providing lubricant droplets having narrow particle size distributions using a limited coalescence process to improve the lubricating properties of photographic elements are given in U.S. Pat. No. 5,541,048 and U.S. Pat. No. 6,068,957. The use of fluoro-containing compounds as lubricants for imaging elements is also known in the art. The incorporation of sub-micron particles of fluoroethylene polymers into a transparent magnetic layer on photographic film, e.g., is described in U.S. Pat. No. 5,807,661. A lubricant layer comprising a fluoropolymer resin coated on a transparent magnetic layer by vapor deposition is disclosed in U.S. Pat. No. 6,228,570. The use of tetrafluoroethylene telomers for improving the lubricity and abrasion resistance of photographic films is described in U.S. Pat. No. 3,862,860. A method of forming polymer particles containing a fluorinated lubricant for use in the overcoat layer of an imaging element is given in U.S. Pat. No. 6,165,702. Lubricant particles having a mean size greater than 1 micron employed in the protective overcoat of a photographic paper is described in U.S. Pat. No. 6,613,503. A photographic element with improved scratch resistance containing lubricant particles having a narrow size distribution and a droplet size related to the thickness of the overcoat layer is disclosed in U.S. Pat. No. 5,529,891. Photographic elements comprising highly lubricated protective outermost layers in combination with both relatively low $T_g$ crosslinked elastomeric matte particles and higher $T_g$ permanent matte particles to provide good manufacturability of the imaging element while also maintaining wear and other desired film performance properties are described in U.S. Pat. No. 6,913,874.

SUMMARY OF THE INVENTION

It has been found that substantial synergistic improvements in abrasion resistance of photographic elements can surprisingly be achieved using a combination of a low friction overcoat layer and underlying cyan dye forming layer having sufficiently low levels of permanent coupler solvent.

In accordance with one embodiment, the invention is directed towards a silver halide light-sensitive photographic element comprising a support having on one side thereof at least one cyan image forming hydrophilic colloid layer comprising a cyan image dye forming coupler, and an outermost protective overcoat layer providing a coefficient of friction of less than 0.20 after standard ECP-2B processing, wherein the ratio of permanent solvent to coupler in the cyan image forming layer is less than 0.8.

DETAILED DESCRIPTION

Photographic elements of the invention comprise a support having on one side thereof at least one cyan image forming hydrophilic colloid layer comprising a cyan image dye forming coupler, and an outermost protective overcoat layer which provides a coefficient of friction of less than 0.20 after photographic processing according to standard ECP-2B Color Print Development Process, as described in the Kodak H-24 Manual, "Manual for Processing Eastman Color Motion Picture Films", Eastman Kodak Company, Rochester, N.Y., the disclosure of which is incorporated by reference herein. The mathematical expression for coefficient of friction, or COF, is as follows:

$$COF=\mu=(\text{friction force/normal force})$$

The coefficient of friction (COF) of an outermost protective layer of a photographic element in accordance with the present invention may be conveniently determined by measuring the lateral force created by moving a sample of the element at 1 inch/sec when the surface of the outermost protective layer is in contact with an 8 mil radius sapphire stylus under 10 g normal force. Photographic elements which enable obtaining the specified low coefficient of friction after standard ECP-2B processing will generally require use of sufficiently high levels of a lubricant to survive such standard processing and provide such low coefficient of friction, as more fully described and demonstrated in the examples below.

The outermost protective overcoat may typically comprise film-forming binder, lubricant, and matting agent. Useful lubricants include silicones (e.g., polydimethyl siloxanes), perfluorinated polymer particles (e.g., polytetrafluoroethylene (PTFE)), natural and synthetic waxes, stearates, amides, higher alcohol esters of fatty acids, higher fatty acid calcium salts, paraffins and the like as described in, e.g., U.S. Pat. Nos. 2,588,756, 3,121,060, 3,295,979, 3,042,522 and 3,489,567. Photographic elements which enable obtaining the specified low coefficient of friction after standard ECP-2B processing will generally require use of relatively high levels of a conventional wax or siloxane lubricant (e.g., more than 50 mg/m$^2$) and/or a fluorinated polymeric material such as PTFE. Use of fluorinated polymeric material lubricants is preferred, with or without conventional wax or siloxane lubricants, as such fluorinated polymeric materials do not scatter light to the same degree as wax and siloxane lubricants when employed at high levels. While lubricant levels of above 50 mg/m$^2$ have previously been thought to provide little additional wear protection, such high levels, and even higher levels of at least 80 mg/m$^2$, are particularly preferred in combination with low solvent cyan dye image forming layers in accordance with the invention to provide improved wear performance of the emulsion layer side of the photographic element. Aqueous dispersed lubricants are strongly preferred, since lubricants in this form can be incorporated directly into an aqueous coated protective layer formula, thus avoiding the need for a separately applied lubricant overcoat on the protective topcoat layer.

The use of film-forming hydrophilic colloids as binders in photographic elements, including photographic films and photographic papers, is well known. The most commonly used of these is gelatin and gelatin is a particularly preferred material for use in the outermost protective overcoat layer of this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar—agar, arrowroot, albumin, and the like. Still other useful hydrophilic colloids are water-soluble polyvinyl compounds such as polyvinyl alcohol, polyacrylamide, poly(vinylpyrrolidone), and the like.

A combination of both relatively low $T_g$ crosslinked elastomeric matte particles and higher $T_g$ permanent matte particles may be employed in the highly lubricated outermost protective layer to provide good manufacturability of the imaging element while also maintaining wear and other desired film performance properties, as described in U.S. Pat. No. 6,913,874, the disclosure of which is incorporated by reference. In particular, where a backcoat layer is employed on the side of the support opposite to the outermost protective overcoat layer, it may be preferred that the protective overcoat and the backcoat each comprise at least 1 mg/m$^2$ of permanent matting agent having a $T_g$ of at least 40° C. and an average size of from about 0.5 to about 3 micrometers, preferably of from about 0.75 to about 2.5 micrometers. Preferably, the total amount of relatively high $T_g$ permanent matte in the overcoat and backcoat layers combined may be from about 10 to 50 mg/m$^2$, more preferably from about 15 to 40 mg/m$^2$. By providing that the protective overcoat and backcoat each comprise at least 1 mg/m$^2$ of relatively high $T_g$ permanent matte, and that the total is preferably at least 10 mg/m$^2$, good transport characteristics may be exhibited throughout the entire manufacturing process and use of the film. The high $T_g$ permanent matting agent may be silica or other mineral oxides, calcium carbonate, glass spheres, ground polymers, or polymeric matte beads. Polymeric matte beads are preferred because of their uniformity of shape and uniformity of size distribution. The high $T_g$ polymeric matte beads may be crosslinked or uncrosslinked. The surface of the matte beads may be attached to gelatin or other hydrophilic colloids to improve their dispersibility in aqueous media. The polymeric matte beads may be prepared by a limited coalescence process such as described in U.S. Pat. Nos. 4,965,131 and 5,133,912, which are incorporated herein by reference. Incorporation of a relatively low level (relative to total amount of relatively high $T_g$ permanent matting agent in the protective overcoat and backcoat layers combined) of crosslinked elastomeric matte beads into at least one of the outermost protective layers can substantially improve wound roll integrity while maintaining the improved wear properties provided by the high levels of lubricant. Accordingly, it may be preferred that at least one protective outermost layer of a photographic element in accordance with the invention comprises at least 1 mg/m$^2$ of crosslinked elastomeric matting agent having a $T_g$ of 20° C. or less, preferably 10° C. or less, wherein the crosslinked elastomeric matte is of an average particle diameter of at least 90% of or greater than that of the relatively high $T_g$ permanent matte in the protective outermost layer. The use of elastomeric matte of a particle size of at least close to (i.e., at least 90%) or greater than that of the high $T_g$ permanent matte enables the use of relatively low levels of such matte to be effective. While the relatively low $T_g$, crosslinked elastomeric matte is preferably of a size at least slightly greater than that of the relatively high $T_g$ permanent matte, such crosslinked elastomeric matte is still preferably within the size range of from about 0.5 to about 3 micrometers, more preferably from about 0.75 to about 2.5 micrometers.

Use of low levels of permanent matting may be facilitated by use of soluble matting agent, which is removed upon photographic processing, in combination with the high $T_g$ permanent matte and the low $T_g$ crosslinked elastomeric matte. At least one of the overcoat or backcoat layers of the photographic elements accordingly may additionally comprise soluble matting agent. Soluble matting agent may be any particulate material which is insoluble in water and soluble in aqueous alkali media. Particularly preferred soluble matting agents, e.g., are polymeric matte beads that are copolymers of an alkyl methacrylate and methacrylic acid such as those described in U.S. Pat. No. 2,992,101; 3,767,448; 4,142,894 and 4,447,525. Soluble matting agent, when employed, is preferably of the same average dimensions as the permanent matte (i.e., an average size of from about 0.5 to about 3 micrometers).

In addition to film-forming binder, lubricant, and matting agents, the protective overcoat and any protective backcoat of a photographic element in accordance with the invention may optionally contain surface active agents, antistatic agents, charge control agents, thickeners, ultraviolet light absorbers, processing removable dyes, high boiling point solvents, colloidal inorganic particles, magnetic recording particles, polymer latexes, and crosslinking agents (i.e., hardeners).

Photographic elements in accordance with the invention include at least one cyan image forming hydrophilic colloid layer comprising a cyan image dye forming coupler. Cyan image dye forming couplers that may be used in elements of the invention include such couplers as are described in such representative patents and publications as: U.S. Pat. Nos. 2,367,531; 2, 423,730; 2,474,293; 2,772,162; 2,895,826; 3,002,836; 3,034,892; 3,041,236; 3,936,303; 4,333,999; 4,609,619; 4,883,746; 5,256,526; 5,834,175; and 6,680,165; BP 1,274,523; European Patent Application Nos. 097,042; 102,839; 389,817; 544,322; 556,700; 556,777; 565,096; 570,006; and 574,948; DE 3,624,777; DE 3,700,570; DE 3,936,300; and "Farbkuppler—Eine Literature Ubersicht," published in Agfa Mitteilungen, Band III, pp. 156–175 (1961).

Typical additional cyan couplers are represented by the following formulas CYAN-1 through CYAN-7:

CYAN-1

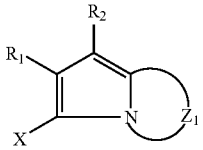

CYAN-2

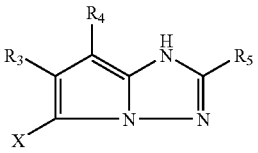

-continued

CYAN-3

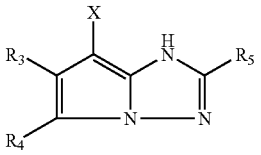

CYAN-4

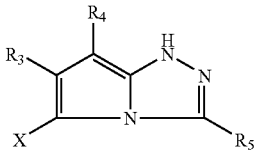

CYAN-5

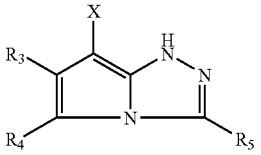

CYAN-6

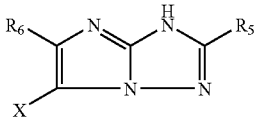

wherein $R_1$ and $R_5$ each represent a hydrogen or a substituent; $R_2$ represents a substituent; $R_3$ and $R_4$ each represent an electron attractive group having a Hammett's substituent constant $s_{para}$ of 0.2 or more and the sum of the $s_{para}$ values of $R_3$ and $R_4$ is 0.65 or more; $R_6$ represents an electron attractive group having a Hammett's substituent constant $s_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group. A dissociative group has an acidic proton, e.g. —NH—, —CH(R)—, etc., that preferably has a pKa value of from 3 to 12 in water. The values for Hammett's substituent constants can be found or measured as is described in the literature. For example, see C. Hansch and A. J. Leo, *J. Med. Chem.,* 16, 1207 (1973); *J. Med. Chem.,* 20, 304 (1977); and J. A. Dean, *Lange's Handbook of Chemistry,* 12th Ed. (1979) (McGraw-Hill).

CYAN-7

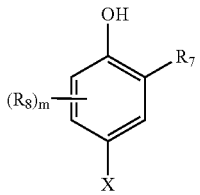

CYAN-8

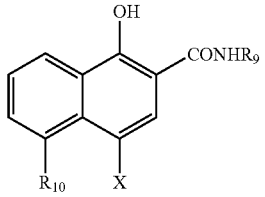

wherein $R_7$ represents a substituent (preferably a carbamoyl, ureido, or carbonamido group); $R_8$ represents a substituent (preferably individually selected from halogen, alkyl, and carbonamido groups); $R_9$ represents a ballast substituent; $R_{10}$ represents a hydrogen or a substituent (preferably a carbonamido or sulphonamido group); X represents a hydrogen or a coupling-off group; and m is from 1–3.

Image dye forming couplers can be incorporated directly in a silver halide emulsion layer of a silver halide photographic element, or in a separate layer associated with an emulsion layer of a silver halide photographic element. While the use of high boiling permanent coupler solvents typically advantageously improves coupler reactivity in photographic elements, it has been found that such solvents may also disadvantageously negatively impact the scratch resistance of such elements when incorporated at too high a level. In accordance with the invention, cyan image dye forming coupler is incorporated into a cyan image forming hydrophilic colloid layer at a relatively low total permanent solvent:coupler ratio (less than 0.8:1, more preferably less than or equal to about 0.5:1, and most preferably less than or equal to about 0.4:1). While presence of a permanent solvent is not a requirement for the present invention, depending upon the specific coupler employed, a minimum permanent solvent:coupler ratio of at least about 0.1:1 may also be preferred to provide increased activity and dye stability.

In a preferred embodiment, the photographic elements of the invention comprise at least one cyan image forming hydrophilic colloid layer comprising cyan image dye forming coupler of Formula I:

Formula I:

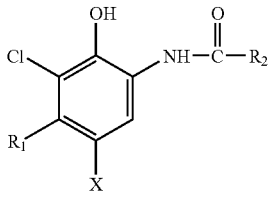

wherein $R_1$ is an alkyl group, $R_2$ is a ballast group, and X is hydrogen or a coupling-off group.

In Formula I, $R_1$ represents an alkyl group substituent, which may be linear or branched, and may be substituted or unsubstituted. Preferably, such alkyl group comprises from 2 to 15 carbon atoms, more preferably from 2 to 4 carbon atoms, and most preferably is an ethyl substituent.

$R_2$ represents a ballast group which controls the migration of the coupler when coated in a photographic layer. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxycarbonyl, carboxy, acyl, acyloxy, amino, anilino, carbonamido (also known as acylamino), carbamoyl, alkylsulfonyl, arylsulfonyl, sulfonamido, and sulfamoyl groups wherein the substituents typically contain 1 to 40 carbon atoms. Such substituents can also be further substituted. Alternatively, the molecule can be made immobile by attachment to a ballast in the form of a polymeric backbone. Preferred ballast groups include —CHR'—O-Aryl, where R' represents an alkyl group (preferably 1 to 12 carbon atoms) and Aryl represents an aryl substituent (e.g., phenyl) which may be substituted by, e.g., an alkyl, hydroxy, or alkylsulfonamido group, with branched alkyl group substituents such as t-butyl and t-pentyl being preferred.

Coupling-off groups are well known in the art. Such groups can modify the reactivity of the coupler and determine the equivalent number of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3, 476,563; 3,617,291; 3,880,661; 4,052,212 and 4,134,766; and in U.K. Patents and published Application Nos. 1,466,728; 1,531,927; 1,533,039; 2,006,755A and 2,017,704A, the disclosures of which are incorporated herein by reference.

Exemplary couplers of Formula I which may be used in an element in accordance with preferred embodiments of the invention include the following:

C-1

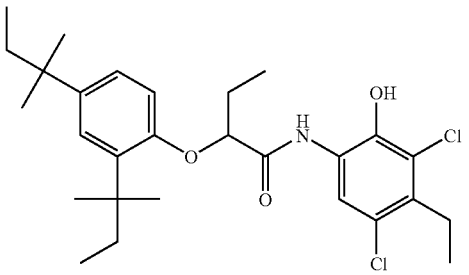

-continued
C-2
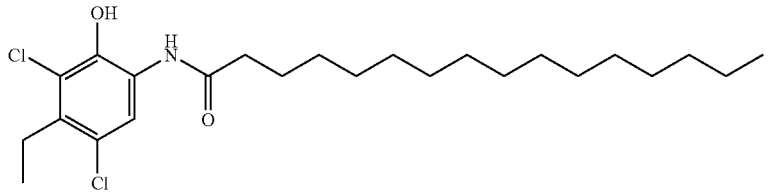
C-3
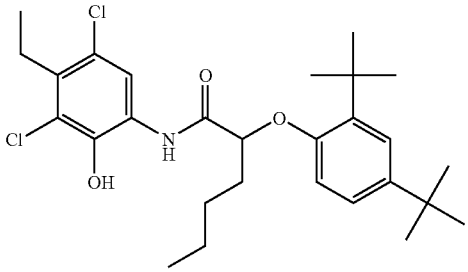
C-4
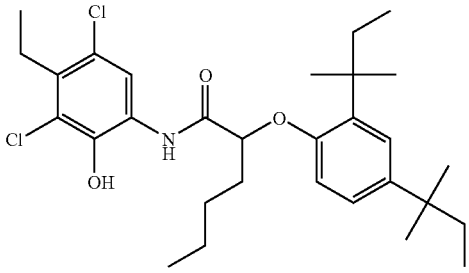
C-5
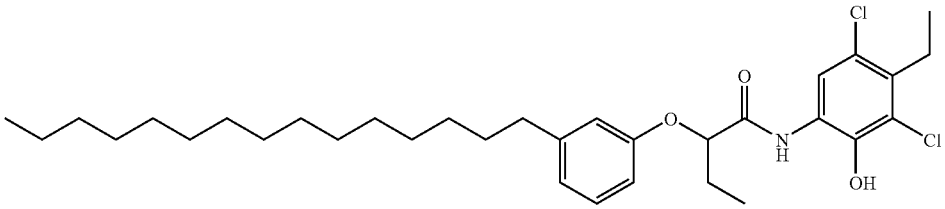
C-6
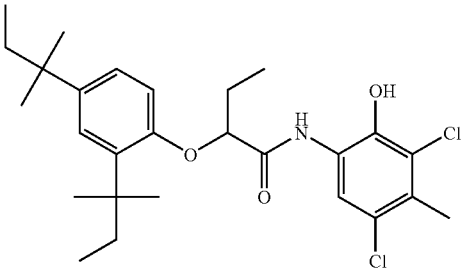
C-7
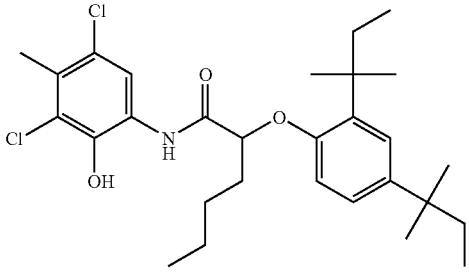

-continued

C-8

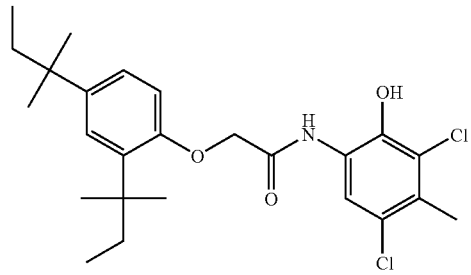

C-9

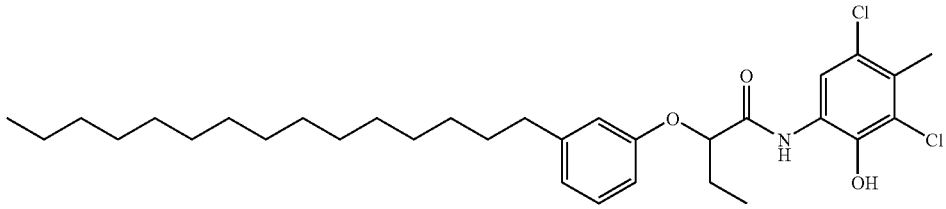

Additional couplers of Formula I which may be used in accordance with the invention include those disclosed in U.S. Pat. Nos. 4,731,320 and 5,009,989, the disclosures of which are hereby incorporated by reference herein.

In general, couplers of Formula I are preferred as they are relatively easy to synthesize and therefore have low manufacturing costs. However, the reactivity of these couplers and the hue and stability of dyes formed from them can be altered greatly by the nature of the dispersion coupler solvent. Phthalic acid esters such as dibutylphthalate have been found to be very useful as coupler solvents in combination with couplers of Formula I. These coupler solvents enable these couplers to provide high reactivity with oxidized color developer. Such solvents also shift the cyan image dye formed from these couplers bathochromically (to longer wavelengths), which is desirable for color reproduction. They also provide cyan image dyes with adequate light and dark stability. Alternative coupler solvents which deliver all of the desired features with couplers of Formula I must meet a fairly specific set of criteria. In order to deliver high coupler reactivity, alternative solvents must have sufficiently low viscosity. It is also necessary for potential alternative solvents to have sufficient polarity to shift the cyan dye hue bathochromically. It is also important for the solvent to be relatively hydrophobic so that most of it remains present in the layer in which it was coated and is not removed from the coating to an appreciable extent during processing in order to provide good dark stability of cyan image dyes formed from these couplers. Benzoic acid ester or diester solvents are taught in U.S. Pat. No. 6,221,571 as alternative coupler solvents which maintain all of the desirable photographic properties when used with cyan couplers of Formula I, and which are more benign in terms of their potential health and environmental effects. Oleyl alcohol was evaluated in U.S. Pat. No. 6,221,571 as a potential alternative solvent, but was found to result in significantly degraded cyan dye dark stability. Saturated alcoholic high boiling solvents have been identified for use with cyan couplers of Formula I in commonly assigned, copending U.S. Ser. No. 11/261,047, filed Oct. 28, 2005, as providing increased activity, so as to enable lower coated levels of materials at equivalent maximum density.

In accordance with a preferred embodiment of the invention, high-boiling solvents of Formula II may be advantageously employed in combination with couplers of Formula I in a cyan image forming hydrophilic colloid layer of a photographic element in accordance with the present invention.

Formula II

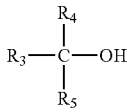

wherein $R_3$ represents an alkyl group, and $R_4$ and $R_5$ individually represent hydrogen or an alkyl group, or $R_3$ and $R_4$ may be joined to form a cycloalkyl group. Preferably, the total number of carbon atoms contained in $R_3$, $R_4$, and $R_5$ is at least 10 and the alcoholic solvent or mixture of solvents of Formula II is liquid at 37° C.

The term "high boiling solvent" as used herein refers to coupler solvents having a boiling point of above about 150° C. The total number of carbon atoms contained in $R_3$, $R_4$, and $R_5$ of the saturated alcoholic compounds of Formula II is preferably at least 10, and more preferably from 10–30, so that the solvent is of sufficient molecular weight to prevent excessive solvent migration between coated photographic element layers. The alcoholic solvent or mixture of solvents of Formula II also is also preferably liquid at 37° C., which is a conventional photographic material development process temperature. By requiring the alcoholic solvent or mixture of solvents of Formula II to be liquid at such temperature, improved photographic coupling activity may be achieved during conventional development processes. In accordance with a preferred embodiment of the invention, the saturated alcoholic high boiling solvent or mixture of solvents of Formula II comprises at least one branched chain saturated alcohol of Formula II (i.e., one in which at least one of $R_4$ and $R_5$ individually represents an alkyl group in addition to $R_3$ representing an alkyl group). While some long straight chain aliphatic alcohols may have melting points of greater than 37° C., lower melting points may be advantageously obtained for equivalent molecular weight saturated alcohols that comprise branched chain structures. In a further particular embodiment, $R_3$ and $R_4$ may be joined to form a cycloalkyl group.

In accordance with preferred embodiments, the solvents of Formula II have a viscosity at 25° C. of less than 100 centipoise, more preferably less than 50 centipoise. While use of higher viscosity solvents of Formula II is included within the invention, such solvents should generally be used in solvent blends with lower viscosity solvents in order to provide desired levels of reactivity for couplers of Formula I. In accordance with most specific embodiments the invention, cyan image dye forming coupler of Formula I and solvent of Formula II are incorporated into a cyan image forming hydrophilic colloid layer at a total permanent solvent:coupler ratio of from about 0.1:1 to less than 0.8:1, more preferably from about 0.1:1 to less than or equal to about 0.5:1, and most preferably from about 0.1:1 to less than or equal to about 0.4:1.

Specific examples of saturated alcoholic compounds of Formula II which may be used in accordance with the invention include the following solvents S-1 through S-13:

S-1:2-Hexyl-1-decanol

S-2:1-Tridecanol

S-3:2-Octyl-1-dodecanol

S-4:1-Undecanol

S-5:1-Dodecanol

S-6:2-Butyl-1-decanol

S-7:2-Butyl-1-octanol

S-8:2-Hexyl-1-octanol

S-9:2-Hexyl-1-dodecanol

S-10:2-Octyl-1-decanol

S-11: Isomyristyl alcohol

S-12: Isohexadecyl alcohol

S-13: Isooctadecanol

The high-boiling alcoholic compound solvents of Formula II may be commercially available, or may be synthesized by methods known in the art.

Unless otherwise specifically stated, the term substituted or substituent means any group or atom other than hydrogen bonded to the remainder of a molecule. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy)butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl] sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

Dispersions of cyan image forming couplers for use in the invention can be prepared by dissolving a cyan image forming couplers in a high boiling solvent, or a high boiling solvent blend, optionally with or without low boiling or partially water soluble auxiliary organic solvents. Alternatively, an auxiliary solvent may be employed without a high boiling solvent. The resulting liquid organic phase may then be mixed with an aqueous gelatin solution, and the mixture is then passed through a mechanical mixing device suitable for high shear or turbulent mixing generally suitable for preparing photographic emulsified dispersions, such as a colloid mill, homogenizer, microfluidizer, high speed mixer, ultrasonic dispersing apparatus, blade mixer, device in which a liquid stream is pumped at high pressure through an orifice or interaction chamber, Gaulin mill, blender, etc., to form small particles of the organic phase suspended in the aqueous phase. More than one type of device may be used to prepare the dispersions. The auxiliary organic solvent, if present, may then be removed by evaporation, noodle washing, or membrane dialysis. If not removed prior to coating in a photographic element layer, partially water soluble auxiliary organic solvents may diffuse throughout the hydrophilic colloid layers of the element, and be removed during photographic processing. The dispersion particles preferably have an average particle size of less than 2 microns, generally from about 0.02 to 2 microns, more preferably from about 0.02 to 0.5 micron. These methods are described in detail in U.S. Pat. Nos. 2,322,027, 2,787,544, 2,801,170, 2,801,171, 2,949,360, and 3,396,027. Preferred coated levels of high-boiling solvents in the cyan image forming layer range from about 0.02 to about 1.0 g/sq m, or more preferably from about 0.05 to about 0.7 g/sq m.

Examples of suitable auxiliary solvents which can be used include: ethyl acetate, isopropyl acetate, butyl acetate, ethyl propionate, 2-ethoxyethylacetate, 2-(2-butoxyethoxy) ethyl acetate, triethylcitrate, dimethylformamide, 2-methyl tetrahydrofuran, triethylphosphate, cyclohexanone, butoxyethyl acetate, methyl isobutyl ketone, methyl acetate, 4-methyl-2-pentanol, diethyl carbitol, 1,1,2-trichloroethane, 1,2-dichloropropane, and the like. Preferred auxiliary solvents include ethyl acetate and 2-(2-butoxyethyoxy) ethyl acetate.

While the use of high boiling coupler solvents advantageously improves coupler reactivity in photographic elements, such solvents may also disadvantageously negatively impact the scratch resistance of such elements when incorporated at too high a level. While low levels of high oiling solvents alone may provide an improvement in scratch resistance, in accordance with the invention it has been found that substantial synergistic improvements in abrasion resistance of photographic elements can surprisingly be achieved using a combination of a sufficiently low friction overcoat layer and underlying cyan dye forming layer having sufficiently low levels of permanent coupler solvent.

The aqueous phase of the coupler dispersions preferably comprise gelatin as a hydrophilic colloid. This may be gelatin or a modified gelatin such as acetylated gelatin, phthalated gelatin, oxidized gelatin, etc. Gelatin may be base-processed, such as lime-processed gelatin, or may be acid-processed, such as acid processed ossein gelatin. Other hydrophilic colloids may also be used, such as a water soluble polymer or copolymer including, but not limited to poly(vinyl alcohol), partially hydrolyzed poly(vinylacetate-co-vinyl alcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

Multicolor photographic elements in accordance with preferred embodiments of the invention preferably comprise a support bearing light sensitive image dye forming layers sensitized to the blue (approx. 380–500 nm), green (approx. 500–600 nm), and red (approx. 600–760 nm) regions of the electromagnetic spectrum. In accordance with a preferred embodiment of the invention, the element comprises cyan, magenta and yellow dye forming silver halide emulsion hydrophilic colloid layer units sensitized to the red, green and blue regions of the spectrum. Each unit can comprise a single emulsion layer or multiple emulsion layers sensitive to a given region of the spectrum. The layers of the element, including the layers of the image forming units, can be arranged in various orders as known in the art. It is within the scope of this invention, however, for the light sensitive material to alternatively or additionally be sensitive to one or more regions of the electromagnetic spectrum outside the visible, such as the infrared region of the spectrum. In most color photographic systems, color-forming couplers are incorporated in the light-sensitive photographic emulsion layers so that during development, they are available in the emulsion layer to react with the color developing agent that is oxidized by silver halide image development. Non-diffusing couplers are incorporated in photographic emulsion layers. When the dye image formed is to be used in situ, couplers are selected which form non-diffusing dyes. Color photographic systems can also be used to produce black-and-white images from non-diffusing couplers as described, e.g., by Edwards et al. in International Publication No. WO 93/012465.

The invention is particularly useful with color photographic print elements, and especially to photographic print elements designed for exposure though a negative film and projection display, such as motion picture print and intermediate films. In color photographic element printing, there are usually three records to record in the image area frame region of a print film, i.e., red, green and blue. The original record to be reproduced is preferably an image composed of sub-records having radiation patterns in different regions of the spectrum. Typically it will be a multicolor record composed of sub-records formed from cyan, magenta and yellow dyes. The principles by which such materials form a color image are described in James, The Theory of the Photographic Process, Chapter 12, Principles and Chemistry of Color Photography, pp 335–372, 1977, Macmillan Publishing Co. New York, and suitable materials useful to form original records are described in *Research Disclosure*, December, 1987, Item 17643, published by Industrial Opportunities Ltd., Homewell Havant, Hampshire, P09 1 EF, United Kingdom, and *Research Disclosure*, September 1994, Item 36544, published by Kenneth Mason Publications, Ltd., Emsworth, Hampshire P010 7DQ, England. Materials in which such images are formed can be exposed to an original scene in a camera, or can be duplicates formed from such camera origination materials, e.g., records formed in color negative intermediate films such as those identified by the tradenames Eastman Color Intermediate Films 2244, 5244 and 7244. Alternatively, the original record may be in the form of electronic image data, which may be used to control a printer apparatus, such as a laser printer, for selective imagewise exposure of a print film in accordance with the invention.

Photographic elements of the invention in accordance with particular embodiments preferably comprise photographic print elements. Relatively small grain, high chloride emulsions (e.g., emulsions having average grain size equivalent circular diameters of less than about 1 micron and halide contents of greater than 50 mole % chloride) are typically used in photographic print films and papers in order to optimize print image quality and enable rapid processing. Such emulsions typically result in relatively low speed photographic elements in comparison to camera negative films. Low speed is compensated for by the use of relatively high intensity print lamps or lasers for exposing such print elements. For comparison purposes, it is noted that print films and papers, such as motion picture color print films, e.g., when rated using the same international standards criteria used for rating camera negative films, would typically have an ISO speed rating of less than 10, which is several stops slower than the slowest camera negative films in current use.

In the following discussion of suitable materials for use in the emulsions and elements that can be used in conjunction with the invention, reference will be made to *Research Disclosure*, September 1994, Item 36544, available as described above, which will be identified hereafter by the term "*Research Disclosure*." The contents of the *Research Disclosure*, including the patents and publications referenced therein, are incorporated herein by reference, and the Sections hereafter referred to are Sections of the *Research Disclosure*, Item 36544.

Suitable silver halide emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing conditions can be found in Sections XI–XX.

It is also contemplated that the materials and processes described in an article titled "Typical and Preferred Color Paper, Color Negative, and Color Reversal Photographic Elements and Processing," published in *Research Disclosure*, February 199S, Item 37038 also may be advantageously used with elements of the invention.

Photographic light-sensitive elements in accordance with the invention may utilize silver halide emulsion image forming layers wherein chloride, bromide and/or iodide are present alone or as mixtures or combinations of at least two halides. The combinations significantly influence the performance characteristics of the silver halide emulsion. Print elements are typically distinguished from camera negative elements by the use of high chloride (e.g., greater than 50 mole % chloride) silver halide emulsions containing no or only a minor amount of bromide (typically less than 40 mole %), which are also typically substantially free of iodide or contain a very small amount of iodide (e.g., less than 1 mole %). As explained in Atwell, U.S. Pat. No. 4,269,927, silver halide with a high chloride content possesses a number of highly advantageous characteristics. For example, high chloride silver halides are more soluble than high bromide silver halide, thereby permitting development to be achieved in shorter times. Furthermore, the release of chloride into the developing solution has less restraining action on development compared to bromide and iodide and this allows developing solutions to be utilized in a manner that reduces the amount of waste developing solution. Since print films are intended to be exposed by a controlled light source, the imaging speed gain which would be associated with high bromide emulsions and/or iodide incorporation offers little benefit for such print films.

Photographic print elements are also distinguished from camera negative elements in that print elements typically comprise only fine silver halide emulsions comprising grains having an average equivalent circular diameter (ECD) of less than about 1 micron, where the ECD of a grain is the diameter of a circle having the area equal to the projected area of a grain. The ECDs of silver halide emulsion grains are usually less than 0.60 micron in red and green sensitized layers and less than 0.90 micron in blue sensitized layers of a color photographic print element. Such fine grain emulsions used in print elements generally have an aspect ratio of less than 1.3, where the aspect ratio is the ratio of a grain's ECD to its thickness. Such grains may take any regular shapes, such as cubic, octahedral or cubo-octahedral (i.e., tetradecahedral) grains, or the grains can take other shapes attributable to ripening, twinning, screw dislocations, etc. Typically, print element emulsions grains are bounded primarily by {100} crystal faces, since {100} grain faces are exceptionally stable. Specific examples of high chloride emulsions used for preparing photographic prints are provided in U.S. Pat. Nos. 4,865,962; 5,252,454; and 5,252,456, the disclosures of which are here incorporated by reference.

The yellow, cyan and magenta dye forming couplers that may be used in the elements of the invention can be defined as being 4-equivalent or 2-equivalent depending on the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art as described above.

Cyan image dye forming couplers of formulas CYAN-1 through CYAN-7 described above may be used alone or in combination in elements of the present invention. In preferred embodiments, cyan image dye forming couplers of Formula I are used alone or in combination with other cyan dye forming couplers.

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent Applications 176,804; 177,765; U.S. Pat. No. 4,659,652; 5,066,575; and 5,250,400.

Typical pyrazoloazole and pyrazolone couplers are represented by the following formulas:

MAGENTA-1

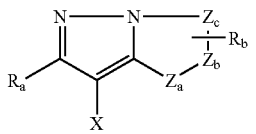

MAGENTA-2

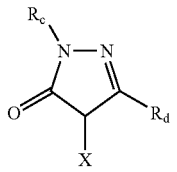

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, ═N—, ═C—, or —NH—, provided that one of either the $Z_a$-$Z_b$ bond or the $Z_b$-$Z_c$ bond is a double bond and the other is a single bond, and when the $Z_b$-$Z_c$ bond is a carbon—carbon double bond, it may form part of an aromatic ring, and at least one of $Z_a$, $Z_b$, and $Z_c$ represents a methine group connected to the group $R_b$.

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred yellow couplers are represented by the following formulas:

YELLOW-1

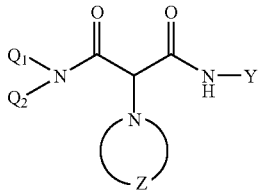

YELLOW-2

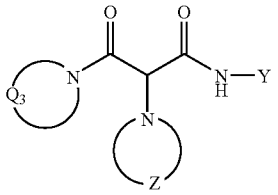

YELLOW-3

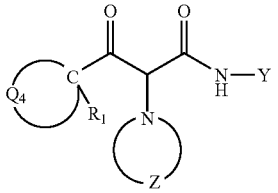

YELLOW-4

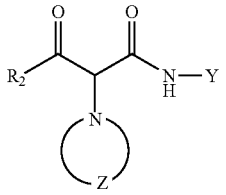

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring. Preferred couplers are of YELLOW-1 and YELLOW-4 wherein $Q_1$ and $Q_2$ each represent an alkyl group, an aryl group, or a heterocyclic group, and $R_2$ represents an aryl or alkyl group, including cycloalkyl and bridged cycloalkyl groups, and more preferably a tertiary alkyl group. Particularly preferred yellow couplers for use in elements of the invention are represented by YELLOW-4, wherein $R_2$ represents a tertiary alkyl group and Y represents an aryl group, and X represents an aryloxy or N-heterocyclic coupling-off group.

Typical examples of photographic substituents which may be included in the yellow, cyan and magenta couplers which may be used in the elements of the invention include alkyl, aryl, anilino, carbonamido, sulfonamido, alkylthio, arylthio, alkenyl, cycloalkyl, and further to these exemplified are halogen, cycloalkenyl, alkynyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues and bridged hydrocarbon compound residues. Usually the substituent will have less than 30 carbon atoms and typically less than 20 carbon atoms. It is understood throughout this specification that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any other photographically useful substituents.

To control the migration of various components coated in a photographic layer, including couplers, it may be desirable to include a high molecular weight hydrophobe or "ballast" group in the component molecule as described above for the cyan couplers.

It may be useful to use a combination of couplers any of which may contain known ballasts or coupling-off groups such as those described in U.S. Pat. Nos. 4,301,235; 4,853,319 and 4,351,897.

If desired, the photographic element can be used in conjunction with an applied magnetic layer as described in *Research Disclosure*, November 1992, Item 34390. It is also specifically contemplated to use photographic elements according to the invention in combination with technology useful in small format film as described in *Research Disclosure*, June 1994, Item 36230. *Research Disclosure* is published by Kenneth Mason Publications, Ltd., Dudley House, 12 North Street, Emsworth, Hampshire P010 7DQ, ENGLAND.

Photographic elements in accordance with the invention may comprise any conventional support materials, which may be reflective or transparent. Preferred supports for elements in accordance with the invention comprise synthetic high molecular weight transparent polymeric films, such as cellulose nitrate and cellulose esters (such as cellulose triacetate and diacetate), polycarbonate, and polyesters of dibasic aromatic carboxylic acids with divalent alcohols such as poly(ethylene terephthalate). The thickness of the support is not critical. Conventional support member thicknesses of from about 50 to 250 microns (2 to 10 mils, or 0.002 to 0.010 inches) can be employed, for example, with very satisfactory results. In addition to the light sensitive image forming layers described above, the photographic elements of the invention may include further features and layers as are known in the art, including, e.g., antistatic, antihalation, subbing, interlayer, backing, and overcoat layers. Polyester supports, e.g., typically employ undercoat or primer layers to improve adhesion of other layers thereto. Such undercoat layers are well known in the art and comprise, e.g., a vinylidene chloride/methyl acrylate/itaconic acid terpolymer or vinyldene chloride/acrylonitrile/acrylic acid terpolymer as described in U.S. Pat. Nos. 2,627,088; 2,698,235; 2,698,240; 2,943,937; 3, 143,421; 3,201,249; 3,271,178; 3,501,301.

Photographic elements of the invention preferably further comprise an antihalation layer comprising process removable filter dyes or silver. The antihalation layer may be located between the light sensitive layers and the support, or may be positioned on the back side of the support opposite to the light sensitive layers. The filter dyes and/or silver used in antihalation layers are preferably designed to be solubilized and removed or decolorized during photographic processing. Conventional processing of photographic print elements include the Kodak ECP-2B Process for motion picture print films, described in Kodak Publication No. H-24, Manual For Processing Eastman Color Films, the disclosure of which is hereby incorporated by reference.

The following examples illustrate the preparation of photographic elements in accordance with this invention.

EXAMPLE 1

80.0 g of cyan coupler C-1 was added to 40.0 g of CS-1 (dibutyl sebacate), 40.0 g of CS-2 (phenylethyl benzoate), and 120.0 g of ethyl acetate and heated to 70° C. to completely dissolve the coupler. This oil phase solution was added to an aqueous phase solution consisting of 80.0 g of Type IV gelatin, 60.0 g of a 10% solution of Alkanol XC (Dupont), and 580.0 g of distilled water at 50 C. This mixture was premixed using a Brinkman rotor-stator device at 5000 rpm for 2 min at 50 C and then passed through a Crepaco homogenizer at 5000 psi. The ethyl acetate was subsequently removed using a rotary evaporator and 10.0 g of 9.24 wt % sulfuric acid and 1.43 g of a 0.7 wt % solution of Kathon LX (Rohm & Haas) and distilled water were added to form Dispersion A, which comprised 8.0% coupler, 8.0% permanent solvent (CS-1+CS-2) and 8.0% gel. Dispersion A was coated in Layer 4 of the multilayer film structure given below as Coating 1. Additional coatings 2–5 were prepared with variations described in Table I. Cyan dispersions were employed at equivalent coupler levels in the various coatings.

| | mg/sq meter |
|---|---|
| Layer 1 | |
| Dye-1 | 129.0 |
| Dye-2 | 56.0 |
| Gelatin | 659 |
| Layer 2 | |
| Blue-sensitive emulsion (3D 0.79 microns, $AgCl_{.995}Br_{.005}$, dyed with sensitizing dye-1 and sensitizing dye-2) | 89.2 |
| Blue-sensitive emulsion (3D 0.42 microns, $AgCl_{.995}Br_{.005}$, dyed with sensitizing dye-1 and sensitizing dye-2) | 238.6 |
| Blue-sensitive emulsion (3D 0.33 microns, $AgCl_{.997}Br_{.003}$, dyed with sensitizing dye-1 and sensitizing dye-2) | 154.2 |
| Coupler Y-1 | 1320 |
| Dye-3 | 20.0 |
| Dye-4 | 7.0 |
| Gelatin | 2500 |
| Layer 3 | |
| Chem-1 | 30.0 |
| Gelatin | 1060 |

-continued

| | mg/sq meter |
|---|---|
| Layer 4 | |
| Red-sensitive emulsion (3D 0.22 microns, $AgCl_{.991}Br_{.009}$, dyed with sensitizing dye-3) | 77.9 |
| Red-sensitive emulsion (3D 0.15 microns, $AgCl_{.991}Br_{.009}$, dyed with sensitizing dye-3) | 271.5 |
| Red-sensitive emulsion (3D 0.12 microns, $AgCl_{.990}Br_{.010}$, dyed with sensitizing dye-3) | 95.6 |
| Coupler C-1 | 868 |
| CS-1 | 434 |
| CS-2 | 434 |
| Dye-5 | 79.0 |
| Gelatin | 2601 |
| Layer 5 | |
| Chem-1 | 30.3 |
| Gelatin | 530 |
| Layer 6 | |
| Green-sensitive emulsion (3D 0.22 microns, $AgCl_{.987}Br_{.013}$, dyed with sensitizing dye-4 and sensitizing dye-5) | 68.2 |
| Green-sensitive emulsion (3D 0.15 microns, $AgCl_{.987}Br_{.013}$, dyed with sensitizing dye-4 and sensitizing dye-5) | 331.2 |
| Green-sensitive emulsion (3D 0.12 microns, $AgCl_{.982}Br_{.018}$, dyed with sensitizing dye-4 and sensitizing dye-5) | 87.6 |
| Coupler M-1 | 636 |
| CS-3 | 127.2 |
| Chem-1 | 10.0 |
| Dye-6 | 42.0 |
| Gelatin | 1433 |
| Layer 7 | |
| Polydimethylsiloxane | 16.5 |
| Gelatin | 876 |

The above coating further contains sequestrants, antifoggants, surfactants, antistat, and matte beads as known in the art. The film also contains hardener at 1.49% of total gelatin.

Dye-1

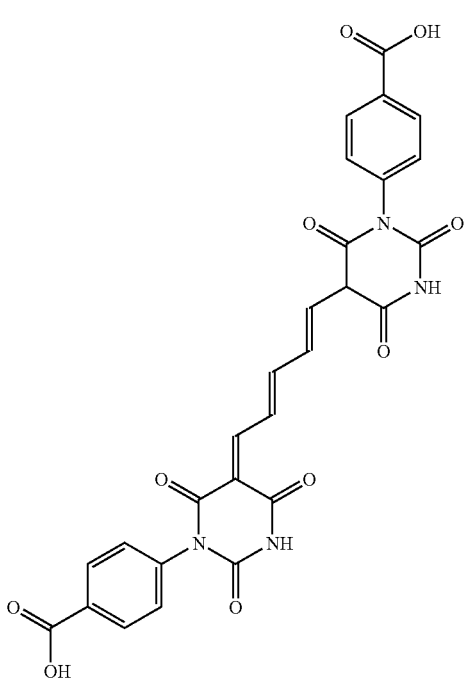

-continued
Dye-2
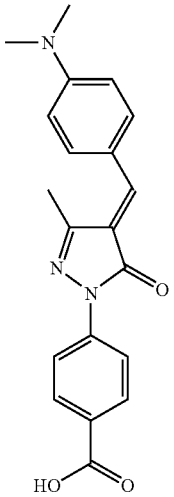
Dye-3
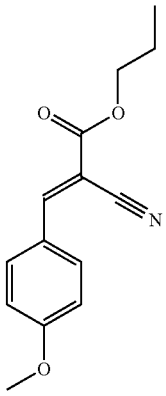
Dye-4
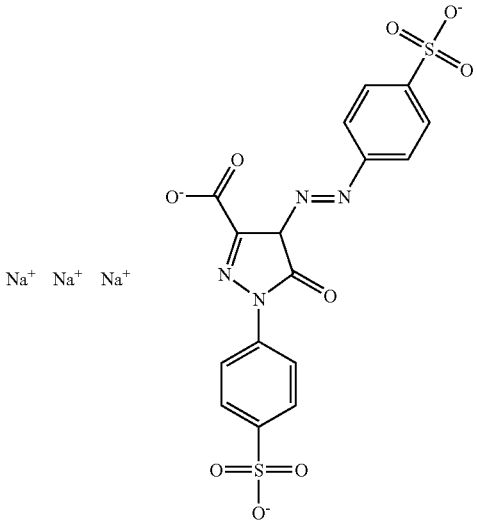
-continued
Dye-5
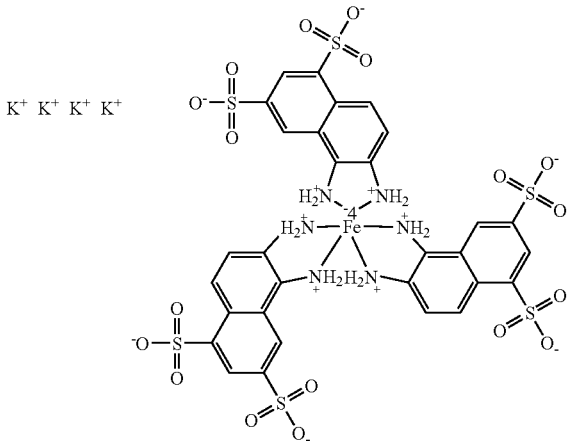
Dye-6
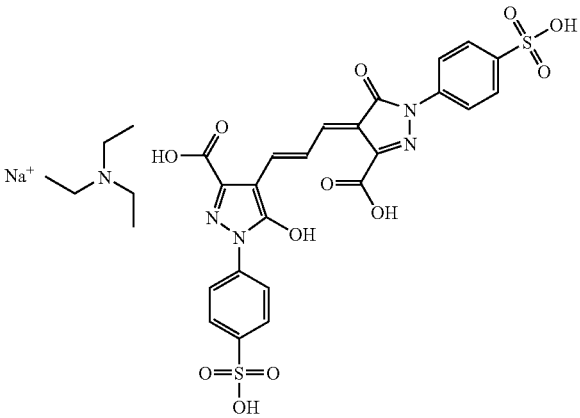
Sensitizing Dye-1
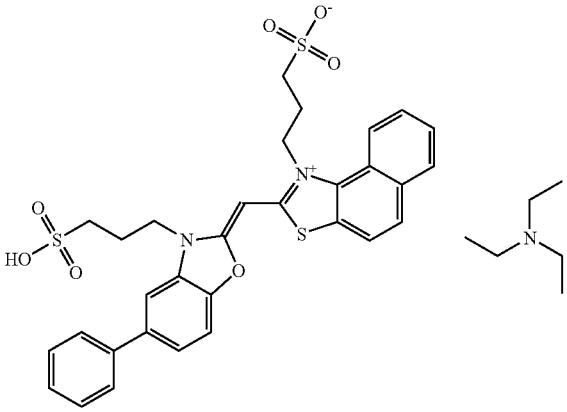

-continued
Sensitizing Dye-2
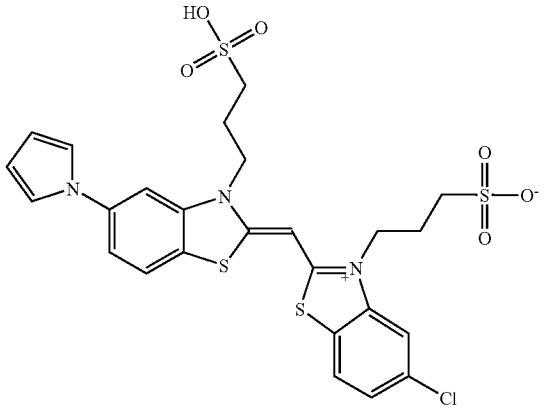
Sensitizing Dye-3
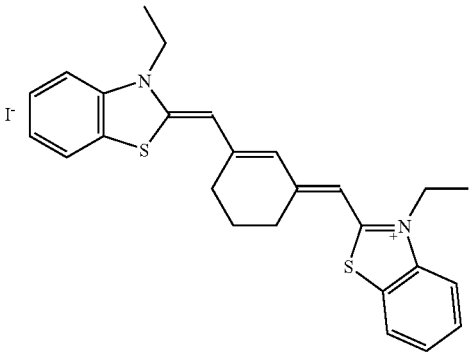
Sensitizing Dye-4
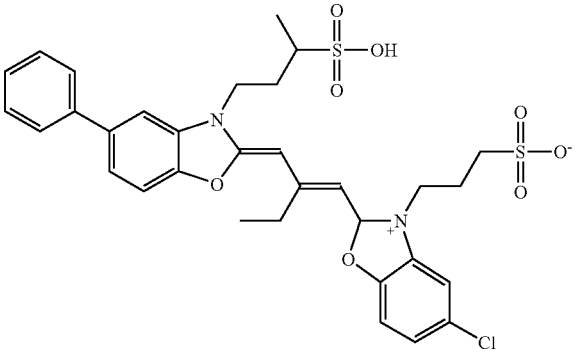
Sensitizing Dye-5
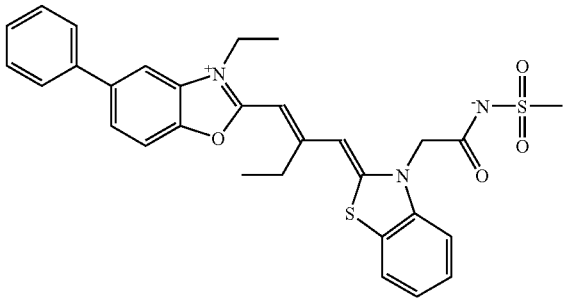
-continued
Chem-1
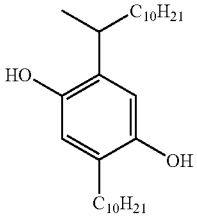
Coupler Y-1
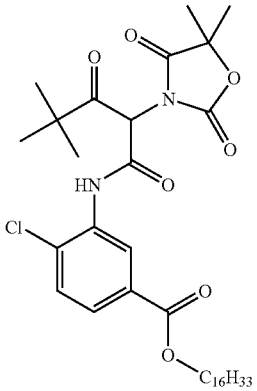
Coupler Y-2
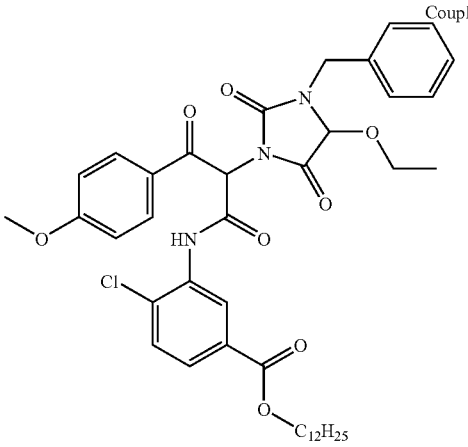
Coupler C-1
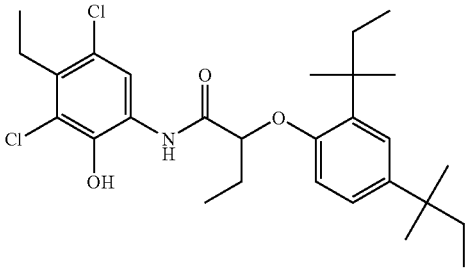

-continued

Coupler M-1

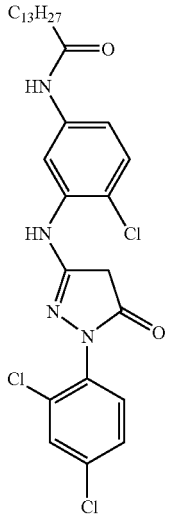

CS-1

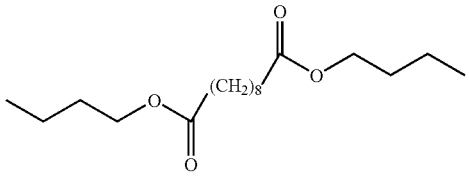

CS-2

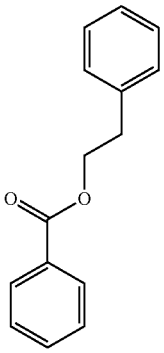

Tri-cresylphosphate

CS-3

CS-4

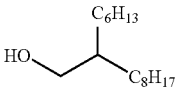

The elements were exposed through a 0–3 neutral density 21-step tablet on a Kodak 1B sensitometer with a 3200K light source. After exposure, the elements were processed according to the standard Kodak ECP-2B Color Print Development Process as described in the Kodak H-24 Manual, "Manual for Processing Eastman Color Motion Picture Films", Eastman Kodak Company, Rochester, N.Y., the disclosure of which is incorporated by reference herein, with the exception that those steps specific to sound track development were omitted. The process consisted of a pre-bath (10"), water rinse (20"), color developer (3'), stop bath (40"), first wash (40"), first fix (40"), second wash (40"), bleach (1'), third wash (40"), second fix (40"), fourth wash (1"), final rinse (10"), and then drying with hot air.

The ECP-2B Prebath Consists of:

| | |
|---|---|
| Water | 800 mL |
| Borax (decahydrate) | 20.0 g |
| Sodium sulfate (anhydrous) | 100.0 g |
| Sodium hydroxide | 1.0 g |
| Water to make 1 liter | |
| pH @ 26.7° C. is 9.25 +/− 0.10 | |

The ECP-2B Color Developer Consists of:

| | |
|---|---|
| Water | 900 mL |
| Kodak Anti-Calcium, No. 4 (40% solution of a pentasodium salt of nitrilo-tri(methylene phosphonic acid) | 1.00 mL |
| Sodium sulfite (anhydrous) | 4.35 g |
| Sodium bromide (anhydrous) | 1.72 g |
| Sodium carbonate (anhydrous) | 17.1 g |
| Kodak Color Developing Agent, CD-2 | 2.95 g |
| Sulfuric acid (7.0N) | 0.62 mL |
| Water to make 1 liter | |
| pH @ 26.7° C. is 10.53 +/− 0.05 | |

The ECP-2B Stop Bath Consists of:

| | |
|---|---|
| Water | 900 mL |
| Sulfuric acid (7.0N) | 50 mL |
| Water to make 1 liter | |
| pH @ 26.7° C. is 0.90 | |

The ECP-2B Fixer Consists of:

| | |
|---|---|
| Water | 800 mL |
| Ammonium thiosulfate (58.0% solution) | 100.0 mL |
| Sodium bisulfate (anhydrous) | 13.0 g |
| Water to make 1 liter | |
| pH @ 26.7° C. is 5.00 +/− 0.15 | |

The ECP-2B Ferricyanide Bleach Consists of:

| | |
|---|---|
| Water | 900 mL |
| Potassium ferricyanide | 30.0 g |
| Sodium bromide (anhydrous) | 17.0 g |
| Water to make 1 liter | |
| pH @ 26.7° C. is 6.50 +/− 0.05 | |

The Final Rinse Solution Consists of:

| | |
|---|---|
| Water | 900 mL |
| Kodak Photo-Flo 200 (TM) Solution | 3.0 mL |
| Water to make 1 liter | |

Processing of the exposed elements was done with the color developing solution adjusted to 36.7° C. The stopping, fixing, bleaching, washing, and final rinsing solution temperatures were adjusted to 26.7° C.

Dispersion B was prepared like Dispersion A except that 80.0 g of cyan coupler C-1 was added to 6.4 g of CS-1, 25.6 g of CS-4 (2-Hexyl-1-decanol), and 133.0 g of ethyl acetate, 80.0 g of Type IV gelatin, 62.5 g of a 10% solution of Alkanol XC (Dupont), and 612.5 g of distilled water were employed. The main difference between Dispersion A and Dispersion B is the large reduction in the overall permanent solvent to coupler ratio, as outlined in Table I. Coatings 2 through 4 were prepared with slight variations in the gelatin level of Layer 3, but large variations in the solvent to coupler ratio (S/C ratio) in Layer 4 (with equivalent coupler levels). In coatings 2 through 4, the coupler solvent in Layer 6 was changed from CS-3 to CS-1, but the level of solvent was kept constant. Coatings 1 and 2 contained 1.3 um polymethylmethacrylate (100) matte beads at 16.2 mg/sqm in the overcoat Layer 7, while Coatings 3, 4, and 5 contained 1.3 um polymethylmethacrylate (100) matte beads at 8.0 mg/sqm and 1.8 um poly[butylacrylate-co-ethylene dimethacrylate (80/20 molar ratio)] at 8.0 mg/sqm. Coatings 3 through 5 also featured the use of polytetrafluoroethylene (PFTE) particles in the overcoat Layer 7 as an additional lubricant.

The coefficient of friction (COF) of the emulsion side of the processed film was obtained by measuring the lateral force created by moving the film at 1 inch/sec in contact with an 8 mil radius sapphire stylus under 10 g normal force. Scratch resistance (SRD) of the emulsion side of the processed film was measured using a CSM Instruments Pin-On-Disk Tribometer equipped with a 15 mil radius diamond stylus, which was contacted with the sample under a 1 N normal load while the sample was rotated at a speed of 5 cm/sec for a maximum of 500 laps. The frictional force was monitored using a force transducer. When significant damage to the sample was detected, visually and with the frictional force signal, the experiment was stopped, and the lap number at which failure occurred was recorded. A higher number of laps indicate greater scratch resistance. A summary of coating variations as well as coefficient of friction and scratch resistance results obtained with film samples processed both at Eastman Kodak Company (Std) and in a customer lab (Trade) are given in Table I below.

TABLE I

Effect of Low Solvent Cyan Layer and Low Friction Overcoat Layer on Scratch Resistance

| Coating | Layer 3 Gel Level | Cyan Disp | Layer 4 Solvent/ Coupler Ratio | Layer 7 PTFE Level | COF (Std) | SRD (Std) | COF (Trade) | SRD (Trade) |
|---|---|---|---|---|---|---|---|---|
| 1 (Comp) | 1060 | A | 1.0 | 0 | 0.24 | 107 | 0.32 | 51 |
| 2 (Comp) | 795 | B | 0.4 | 0 | 0.22 | 332 | 0.25 | 49 |
| 3 (Inv) | 795 | B | 0.4 | 90 | 0.13 | 481 | 0.21 | 245 |
| 4 (Inv) | 1060 | B | 0.4 | 90 | 0.15 | 500 | 0.20 | 366 |
| 5 (Comp) | 1060 | A | 1.0 | 90 | 0.13 | 79 | 0.20 | 57 |

The data in Table I for Coatings 1 and 2 show that a substantial reduction in cyan layer coupler solvent along with a slight reduction in Layer 3 gel level provided a large improvement in scratch resistance using the standard process, but no improvement when the customer process was employed. Coating 5 demonstrates that the addition of PTFE to the overcoat layer significantly lowered the coefficient of friction, but provided no improvement in abrasion resistance. Coatings 3 and 4 demonstrate that the combination of a low solvent cyan layer and a low friction overcoat in accordance with the invention surprisingly resulted in markedly synergistically improved scratch resistance with both processes, regardless of the gel level in Layer 3.

EXAMPLE 2

Dispersion C was prepared like Dispersion A except that 80.0 g of cyan coupler C-1 was added to 32.0 g of CS-1, 32.0 g of CS-2, and 120.0 g of ethyl acetate, 80.0 g of Type IV gelatin, 60.0 g of a 10% solution of Alkanol XC (Dupont), and 596.0 g of distilled water were employed. Coatings 6 through 13 were prepared with variations described in Table II using the multilayer film structure given in Example 1, employing either Dispersion A, B or C at equivalent cyan coupler coating levels, and were subsequently exposed and processed as described in Example 1. In coatings 11 through 13, the coupler solvent in Layer 6 was changed from CS-3 to CS-1, but the level of solvent was kept constant. Coatings 6–8, 11 and 12 contained 1.3 um polymethylmethacrylate (100) matte beads at 16.2 mg/sqm in overcoat Layer 7, while Coatings 9, 10, and 13 contained 1.3 um polymethylmethacrylate (100) matte beads at 5.0 mg/sqm and 1.8 um poly[butylacrylate-co-ethylene dimethacrylate (80/20 molar ratio)] at 8.0 mg/sqm. Coatings 9, 10, and 13 also featured the use of polytetrafluoroethylene (PFTE) particles in the overcoat Layer 7 as an additional lubricant. Results from coefficient of friction and scratch resistance measurements are given in Table II.

TABLE II

Effect of Low Solvent Cyan Layer and Low Friction Overcoat Layer on Scratch Resistance

| Coating | Layer 3 Gel Level | Cyan Disp | Layer 4 Solvent/ Coupler Ratio | Layer 7 PTFE Level | COF (Std) | SRD (Std) | COF (Trade) | SRD (Trade) |
|---|---|---|---|---|---|---|---|---|
| 6 (Comp) | 1060 | A | 1.0 | 0 | 0.22 | 70 | 0.29 | 46 |
| 7 (Comp) | 1325 | A | 1.0 | 0 | 0.22 | 69 | 0.29 | 59 |
| 8 (Comp) | 1590 | A | 1.0 | 0 | 0.23 | 62 | 0.31 | 59 |
| 9 (Comp) | 1060 | A | 1.0 | 90 | 0.17 | 80 | 0.14 | 50 |
| 10 (Comp) | 795 | C | 0.8 | 90 | 0.16 | 283 | 0.14 | 33 |
| 11 (Comp) | 1060 | B | 0.4 | 0 | 0.24 | 243 | 0.31 | 89 |
| 12 (Comp) | 795 | B | 0.4 | 0 | 0.25 | 395 | 0.26 | 42 |
| 13 (Inv) | 795 | B | 0.4 | 90 | 0.18 | 500 | 0.14 | 235 |

The data in Table II show that increased gel level in Layer 3 (Coatings 6 through 8) provided no improvement in scratch resistance using the standard process. As previously observed, the addition of PTFE to the overcoat layer (Coating 9) dramatically lowered the coefficient of friction, but provided very little improvement in abrasion resistance. The combination of a low friction overcoat and a modest solvent reduction in the cyan layer (Coating 10) showed some improvement in scratch resistance with the standard process, but no improvement with the customer process. Substantially reduced cyan layer solvent with no reduction in interlayer gel level (Coating 11) provided some improvement in scratch resistance with the standard process, and a modest improvement with the customer process, which was degraded when the gel level in Layer 3 was reduced (Coating 12). Only the combination of a low solvent cyan layer and a low friction overcoat (Coating 13) resulted in substantially synergistically improved scratch resistance with both processes, even with reduced gel level in Layer 3.

EXAMPLE 3

Coating 14 was prepared using the following multilayer film structure. Additional coatings 15 through 20 were prepared with variations described in Table III. Each Coating was subsequently exposed and processed as described in Example 1.

| | mg/sq meter |
|---|---|
| Layer 1 | |
| Dye-1 | 129.0 |
| Dye-2 | 56.0 |
| Gelatin | 659 |
| Layer 2 | |
| Blue-sensitive emulsion (3D 0.79 microns, $AgCl_{.995}Br_{.005}$, dyed with sensitizing dye-1 and sensitizing dye-2) | 124.6 |
| Blue-sensitive emulsion (3D 0.42 microns, $AgCl_{.995}Br_{.005}$, dyed with sensitizing dye-1 and sensitizing dye-2) | 332.2 |
| Blue-sensitive emulsion (3D 0.33 microns, $AgCl_{.997}Br_{.003}$, dyed with sensitizing dye-1 and sensitizing dye-2) | 298.2 |
| Coupler Y-1 | 1950 |
| Dye-3 | 40.0 |
| Dye-4 | 9.0 |
| Chem-1 | 15.0 |
| Gelatin | 3040 |
| Layer 3 | |
| Chem-1 | 15.0 |
| Gelatin | 1060 |
| Layer 4 | |
| Red-sensitive emulsion (3D 0.22 microns, $AgCl_{.991}Br_{.009}$, dyed with sensitizing dye-3) | 92.4 |
| Red-sensitive emulsion (3D 0.15 microns, $AgCl_{.991}Br_{.009}$, dyed with sensitizing dye-3) | 184.8 |
| Red-sensitive emulsion (3D 0.12 microns, $AgCl_{.990}Br_{.010}$, dyed with sensitizing dye-3) | 338.8 |
| Coupler C-1 | 1120 |
| CS-1 | 560 |
| CS-2 | 560 |
| Dye-5 | 87.5 |
| Gelatin | 3211 |
| Layer 5 | |
| Chem-1 | 15.0 |
| Gelatin | 530 |
| Layer 6 | |
| Green-sensitive emulsion (3D 0.22 microns, $AgCl_{.987}Br_{.013}$, dyed with sensitizing dye-4 and sensitizing dye-5) | 101.7 |
| Green-sensitive emulsion (3D 0.15 microns, $AgCl_{.987}Br_{.013}$, dyed with sensitizing dye-4 and sensitizing dye-5) | 179.2 |
| Green-sensitive emulsion (3D 0.12 microns, $AgCl_{.982}Br_{.018}$, dyed with sensitizing dye-4 and sensitizing dye-5) | 411.1 |
| Coupler M-1 | 890.0 |
| CS-3 | 178.0 |
| Chem-1 | 7.5 |
| Dye-6 | 61.0 |
| Gelatin | 1925 |
| Layer 7 | |
| Polydimethylsiloxane | 16.5 |
| Gelatin | 876 |

The above coating further contains sequestrants, antifoggants, surfactants, antistat, and matte beads as known in the art. The film also contains hardener at 1.49% of total gelatin.

In coatings 15 through 19, the coupler solvent in Layer 6 was changed from CS-3 to CS-1, but the level of solvent was kept constant. Coatings 14 and 15 contained 1.3 um polymethylmethacrylate (100) matte beads at 16.2 mg/sqm in overcoat Layer 7, while Coatings 16, 17, 18, and 20 contained 1.3 um polymethylmethacrylate (100) matte beads at 5.0 mg/sqm and 1.8 um poly[butylacrylate-co-ethylene dimethacrylate (80/20 molar ratio)] at 8.0 mg/sqm and Coating 19 contained 1.0 um polymethylmethacrylate (100) matte beads at 5.0 mg/sqm and 1.3 um poly[butylacrylate-co-ethylene dimethacrylate (80/20 molar ratio)] at 8.0 mg/sqm. Coatings 16–17 and 19–20 also featured the use of polytetrafluoroethylene (PFTE) particles in the overcoat Layer 7 as an additional lubricant in combination with silicone lubricant, while Coating 18 featured the use of polytetrafluoroethylene (PFTE) particles in the overcoat Layer 7 in place of silicone lubricant. Results from coefficient of friction and scratch resistance measurements are given in Table III.

TABLE III

Effect of Low Solvent Cyan Layer and Low Friction Overcoat Layer on Scratch Resistance

| Coating | Layer 3 Gel Level | Cyan Disp | Layer 4 Solvent/ Coupler Ratio | Layer 7 PTFE Level | COF (Std) | SRD (Std) | COF (Trade) | SRD (Trade) |
|---|---|---|---|---|---|---|---|---|
| 14 (Comp) | 1060 | A | 1.0 | 0 | 0.23 | 64 | 0.33 | 57 |
| 15 (Comp) | 1060 | B | 0.4 | 0 | 0.26 | 245 | 0.32 | 234 |
| 16 (Inv) | 795 | B | 0.4 | 90 | 0.10 | 411 | 0.15 | 310 |
| 17 (Inv) | 795 | B | 0.4 | 60 | 0.13 | 434 | 0.19 | 289 |
| 18 (Comp) | 795 | B | 0.4 | 50 | 0.20 | 171 | 0.30 | 128 |
| 19 (Inv) | 795 | B | 0.4 | 90 | 0.12 | 432 | 0.14 | 333 |
| 20 (Comp) | 1060 | C | 0.8 | 90 | 0.11 | 163 | 0.14 | 81 |

The data in Table III show that the lower solvent cyan dispersion (Coating 15) provided somewhat improved scratch resistance with both processes. Slightly improved scratch resistance was also obtained with an intermediate reduction in friction by using a moderate level of PTFE in the overcoat without any silicone lubricant (Coating 18). However, synergistically greater improvements were obtained with both processes when the low solvent dispersion was combined with a low friction overcoat containing PTFE particles (Coatings 16, 17 and 19), which would not have been expected based on the results for Coatings 5 and 9 in Examples 1 and 2. Coating 20 illustrates that a moderate reduction in cyan dispersion solvent combined with a low friction overcoat yielded only modestly improved scratch resistance.

EXAMPLE 4

Coatings 21 through 27 were prepared with variations described in Table IV using the multilayer film structure given in Example 1 and were subsequently exposed and processed using standard ECP-2B as described in Example 1. Coatings 21 and 22 were prepared like Coating 1 in Example 1. Coating 23 was prepared like Coating 21 except that 50% of Coupler Y-1 in Layer 2 was replaced with Coupler Y-2. Coatings 24 through 27 feature additional variations in Layers 2, 3, and 4, as described in Table IV. All coatings contained 1.3 um polymethylmethacrylate (100) matte beads at 16.2 mg/sqm in overcoat Layer 7. Scratch resistance (SRD) of the emulsion side of the processed film was measured using a 15 mil radius diamond stylus (SRD) as described in Example 1 and also with a 15 mil radius sapphire stylus (SRS) as used in co-pending U.S. Ser. No. 11/261,047 incorporated by reference above.

TABLE IV

Scratch Resistance Data with Diamond Stylus (SRD) vs Sapphire (SRS)

| Coating | Layer 2 Couplers | Layer 3 Gel Level | Cyan Disp | Layer 4 Solvent/ Coupler Ratio | SRD (laps) | SRS (laps) |
|---|---|---|---|---|---|---|
| 21 (Comp) | Y-1 | 1060 | A | 1.0 | 58 | 209 |
| 22 (Comp) | Y-1 | 1060 | A | 1.0 | 58 | 268 |
| 23 (Comp) | Y-1/Y-2 | 530 | A | 1.0 | 65 | 332 |
| 24 (Comp) | Y-1/Y-2 | 795 | C | 0.8 | 80 | 500 |
| 25 (Comp) | Y-1/Y-2 | 530 | C | 0.8 | 89 | 500 |
| 26 (Comp) | Y-1/Y-2 | 530 | C | 0.8 | 94 | 500 |
| 27 (Comp) | Y-1/Y-2 | 530 | C | 0.8 | 95 | 500 |

The data in Table IV illustrate that the scratch resistance data obtained using the diamond stylus (SRD) showed failure (scratching) at a much lower number of laps than with the sapphire stylus (SRS) and therefore represents a much more severe test. Hence, the improvements in abrasion resistance provided by the present invention illustrated with respect to SRD values in Examples 1–3 are much greater than those exhibited in referenced copending application U.S. Ser. No. 11/261,047.

This invention has been described in detail with particular reference to preferred embodiments thereof. It will be understood that variations and modifications can be made within the spirit and scope of the invention.

The invention claimed is:

1. A silver halide light-sensitive photographic element comprising a support having on one side thereof at least one cyan image forming hydrophilic colloid layer comprising a cyan image dye forming coupler, and an outermost protective overcoat layer providing a coefficient of friction of less than 0.20 after standard ECP-2B processing, wherein the ratio of permanent solvent to coupler in the cyan image forming layer is less than 0.8.

2. A photographic element according to claim 1, wherein the ratio of permanent solvent to coupler in the cyan image forming layer is less than or equal to about 0.5:1.

3. A photographic element according to claim 2, wherein the ratio of permanent solvent to coupler in the cyan image forming layer is less than or equal to about 0.4:1.

4. A photographic element according to claim 1, wherein the outermost protective overcoat layer comprises a lubricant present in an amount above 50 mg/m$^2$.

5. A photographic element according to claim 4, wherein the outermost protective overcoat layer comprises a lubricant present in an amount of at least 80 mg/m$^2$.

6. A photographic element according to claim 1, wherein the outermost protective overcoat layer comprises a fluorinated polymeric lubricant.

7. A photographic element according to claim 6, wherein the fluorinated polymeric lubricant comprises polytetrafluoroethylene.

8. A photographic element according to claim 1, wherein the element comprises a multicolor motion picture photographic print film element comprising a support bearing in sequential order on one side thereof at least one yellow image forming hydrophilic colloid layer comprising a blue-sensitive silver halide emulsion and yellow image dye forming coupler, at least one cyan image forming hydrophilic colloid layer comprising red-sensitive silver halide emulsion and cyan image dye forming coupler wherein the ratio of permanent solvent to coupler in the cyan image forming layer is less than 0.8, at least one magenta image forming hydrophilic colloid layer comprising green-sensitive silver halide emulsion and magenta image dye forming coupler, and an outermost protective overcoat layer providing a coefficient of friction of less than 0.20 after standard ECP-2B processing.

9. A photographic element according to claim 8, wherein the cyan image forming hydrophilic colloid layer comprises cyan image dye forming coupler of Formula I:

Formula I

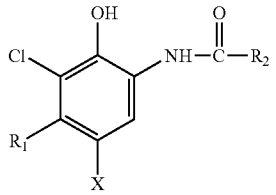

wherein $R_1$ is an alkyl group, $R_2$ is a ballast group, and X is hydrogen or a coupling-off group.

10. A photographic element according to claim 9, wherein the cyan image forming hydrophilic colloid layer comprises a saturated alcoholic high boiling solvent or mixture of solvents of Formula II:

Formula II

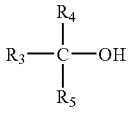

wherein $R_3$ represents an alkyl group, and $R_4$ and $R_5$ individually represent hydrogen or an alkyl group, or $R_3$ and $R_4$ may be joined to form a cycloalkyl group.

11. A photographic element according to claim 10, wherein the total number of carbon atoms contained in $R_3$, $R_4$, and $R_5$ is at least 10 and the alcoholic solvent or mixture of solvents of Formula II is liquid at 37° C.

12. A photographic element according to claim 11, wherein at least one of $R_4$ and $R_5$ represents an alkyl group.

13. A photographic element according to claim 11, wherein the total number of carbon atoms contained in $R_3$, $R_4$, and $R_5$ is from 10–30.

14. A photographic element according to claim 11, wherein the viscosity of the alcoholic solvent or mixture of solvents of Formula II at 25° C. is less than 50 centipoise.

15. A photographic element according to claim 11, wherein the alcoholic solvent or mixture of solvents of Formula II comprises: 2-Hexyl-1-decanol.

16. A photographic element according to claim 11, wherein the ratio of permanent solvent to coupler in the cyan image forming layer is from about 0.1:1 to less than or equal to about 0.5:1.

17. A photographic element according to claim 16, wherein the ratio of permanent solvent to coupler in the cyan image forming layer is from about 0.1:1 to less than or equal to about 0.4:1.

18. A photographic element according to claim 11, wherein the outermost protective overcoat layer comprises a lubricant present in an amount above 50 $mg/m^2$.

19. A photographic element according to claim 11, wherein the outermost protective overcoat layer comprises a fluorinated polymeric lubricant.

20. A photographic element according to claim 19, wherein the fluorinated polymeric lubricant comprises polytetrafluoroethylene.

* * * * *